US005954584A

United States Patent [19]

Yagi

[11] Patent Number: 5,954,584

[45] Date of Patent: Sep. 21, 1999

[54] MOVABLE OBJECT POSITION DETECTING APPARATUS

[75] Inventor: Hiroshi Yagi, Tokyo, Japan

[73] Assignee: Sega Enterprises, Ltd., Tokyo, Japan

[21] Appl. No.: 08/810,937

[22] Filed: Feb. 27, 1997

[30] Foreign Application Priority Data

Feb. 27, 1996 [JP] Japan ..... 8-039928

[51] Int. Cl.[6] ..... A63B 71/00

[52] U.S. Cl. ..... 463/60

[58] Field of Search ..... 463/6, 25, 29, 463/30, 36, 58, 59, 60, 61, 62, 63, 64, 65, 66, 67, 68, 69, 39, 42; 273/138.2, 139

[56] References Cited

U.S. PATENT DOCUMENTS 3,587,100 6/1971 Doremus et al. ..... 463/6
3,815,912 6/1974 Wichinsky et al. ..... 463/60
5,320,351 6/1994 Suzuki ..... 463/6
5,472,192 12/1995 Eto ..... 463/6
5,601,490 2/1997 Nakagawa et al. ..... 463/63
5,649,863 7/1997 Wada et al. ..... 463/62

*Primary Examiner*—Jessica J. Harrison
*Assistant Examiner*—John Paradiso
*Attorney, Agent, or Firm*—Dickstein Shapiro Morin & Oshinksy, LLP

[57] ABSTRACT

In a movable object position detecting apparatus, first oscillation means 56 for outputting an oscillation signal of a first frequency, and second oscillation means 57 for outputting an oscillation signal of a second frequency are mounted on a movable body 40. On the field 3 for the movable objects 40 to be run on there are provided first position determining means 371, 372 for detecting the oscillation signal of the first frequency outputted by the first oscillation means 56 to determine positions on the field 3 where the first oscillation means 56 is located, and second position determining means 373, 374 for detecting the oscillation signal of the second frequency outputted by the second oscillation means 57 to determine positions on the field where the second oscillation means 57 is located. The movable object position detecting apparatus can detect positions of a number of movable bodies run on a predetermined field.

9 Claims, 10 Drawing Sheets

MOVABLE OBJECT POSITION DETECTING APPARATUS

BACKGROUND OF THE INVENTION

The present invention relates to a movable object position detecting apparatus for detecting a position of a movable object running in a fixed field, more specifically to a movable object position detecting apparatus for use in a race game in which movable objects, such as model horses, model cars or others, run a race in a fixed field.

Conventionally there are many kinds of race game devices for games imitating horseraces, car races, etc. In conventional race game devices, movable objects, e.g., model horses, model cars, etc. run on circulatory tracks to compete places or anticipate places. In these race games, however, the movable objects can run only fixed circulatory tracks, which unavoidably reduces actual-site feeling and makes the games much less interesting.

The assignee of the present application filed a Japanese patent application (Japanese Patent Laid-Open Publication No. Sho 63-094884/1988) on an epoch-making race game device in which a race can be competed by free run on a field in place of run along a fixed course on the field. In this race game device, since movable bodies, such as model horses or others can run freely on a field, it is possible to develop a race in which, as in an actual horserace, tricks of running model horses, running a shortest distance, interfering with runs of other model horses, and other techniques are used. Accordingly the race game device can provide race games having actual-site feeling, and is very popular.

In this race game device it is necessary to constantly detect a position of a movable body, and to run the movable body smoothly at a speed which is above a certain speed, it is necessary to detect a current position at a frequency above certain frequency. This has put a limit to a number of movable bodies which are run at once. For example, to detect a position of a movable body above 50 times a second, the currently used race game devices allow only about 6 movable objects to run at one once and cannot meet a desire that a larger number of movable objects would be run at once.

SUMMARY OF THE INVENTION

One object of the present invention is to provide a movable object position detecting apparatus which can detect positions of a large number of movable objects running on a predetermined field.

Another object of the present invention is to provide a race game device using the position detecting apparatus.

The above-described objects are achieved by a movable object position detecting apparatus for detecting a position of a movable object running on a predetermined field, the apparatus comprising: first oscillation means mounted on the movable body for outputting an oscillation signal of a first frequency; second oscillation means mounted on the movable body for outputting an oscillation signal of a second frequency different from the first frequency; first position detecting means disposed on the field for the movable object to be run on for detecting the oscillation signal of the first frequency outputted by the first oscillation means to detect a position on the field where the first oscillation means mounted on the movable object is located; and second position detecting means disposed on the field for the movable object to be run on for detecting the oscillation signal of the second frequency outputted by the second oscillation means to detect a position on the field where the second oscillation means mounted on the movable object is located.

The above-described objects are achieved by a movable object position detecting apparatus for detecting a position of a movable object running on a predetermined field, the apparatus comprising: first oscillation means disposed on the field for the movable object to be run on for outputting oscillation signals of a first frequency, changing oscillation positions of the oscillation signals; second oscillation means disposed on the field for the movable object to be run for outputting oscillation signals of a second frequency different from the first frequency, changing oscillation positions of the oscillation signals; first detecting means mounted on the movable body for detecting the oscillation signals of the first frequency outputted by the first oscillation means; second detecting means mounted on the movable object for detecting the oscillation signals of the second frequency outputted by the second oscillation means; first position detecting means for detecting a position on the field where the first detecting means mounted on the movable body is located, based on a detection result of the first detecting means; and second detecting means for detecting a position on the field where the second detecting means mounted on the movable body is located, based on a detection result of the second detecting means.

The above-described objects are achieved by a race game device which uses the above-described position detecting apparatuses, and in which movable bodies are run for race.

As described above, according to the present invention, positions of a number of movable objects running on a predetermined field can be detected. By applying the present invention to race game devices, a number of movable objects can be raced, which makes the games sophisticated and amusing.

DETAILED DESCRIPTION OF THE INVENTION

A First Embodiment

A race game device according to a first embodiment of the present invention will be explained with reference to FIGS. 1 to 5.

Figure 1:
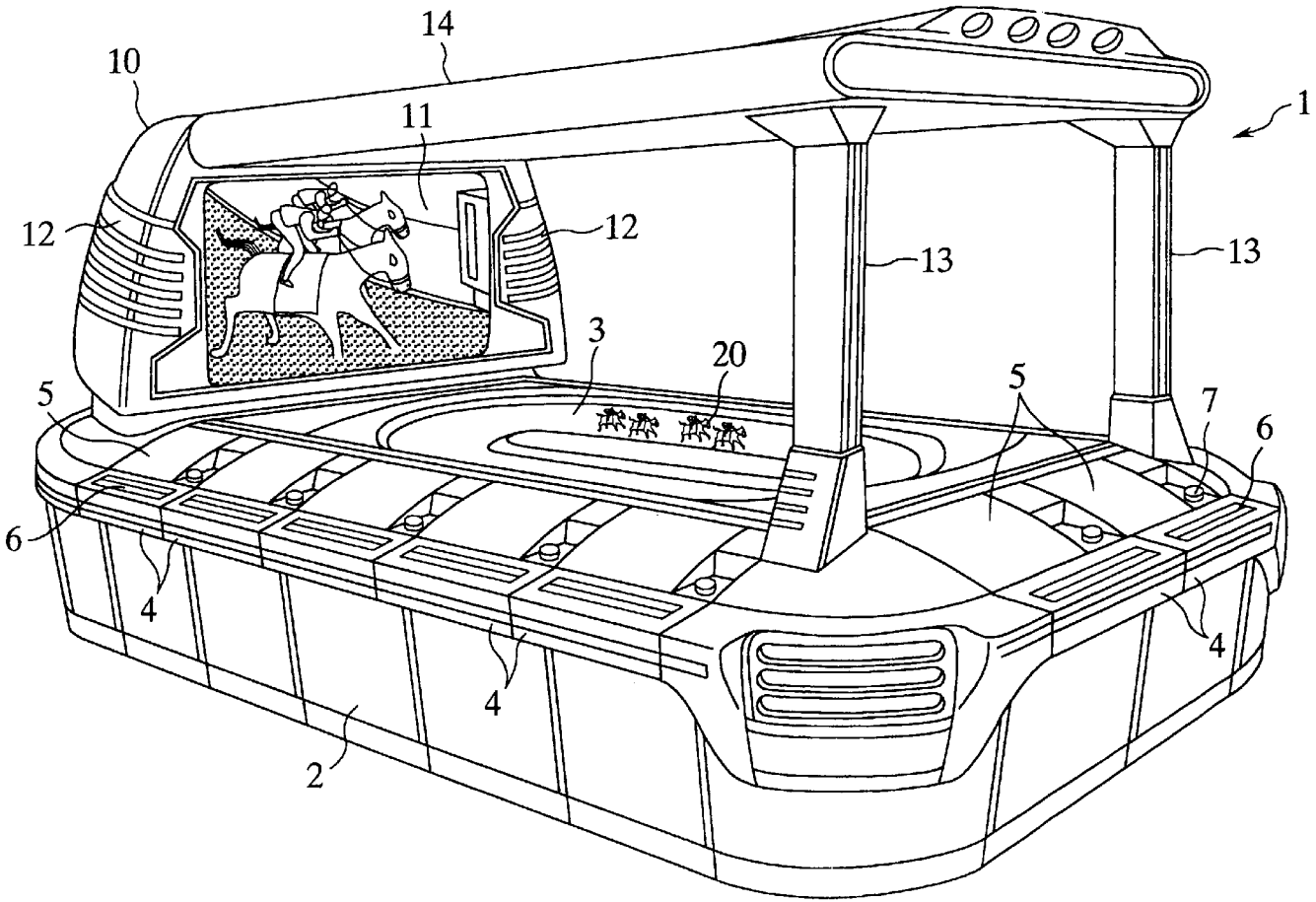
FIG. 1 is a view of an appearance of the horserace game device according to a first embodiment of the present invention.

With reference to FIG. 1, a horserace game device 1 will be briefed.

A circulatory track 3 is provided on an elongate base 2. Six model horses 20 mounted by jockeys 21 can freely run along the track 3.

A plurality of satellites 4 are disposed respectively on one of the curved sides of the base 2 on the foreground, and on both straight sides thereof, which correspond to locations of stands of an actual race track. A monitor 5 is disposed at the center of each satellite 4. An operational panel 6 and a coin slot 7 are disposed below each monitor 5.

A player inserts coins into the slot 7 and operates the operational panel 6 to bet on an anticipated winning horses by single entry or double entry. Introductions, numbers, frames, betting percentages, etc. of horses to race are displayed on the monitor 5.

On the other curved side, which is a location of stands of an actual race track, a large screen 11 is supported on a support wall 10, faced to the track 3. Speakers 12 are built in left and right parts of the support wall 10.

A pair of support poles 13 are disposed on both sides of one curved side, which is a location of the stands of the actual race track. A canopy 14 is spanned between the support poles 13 and the support wall 10. Light means (not shown) is provided on the canopy 14 to illuminate the track 3 from above.

Figure 2:
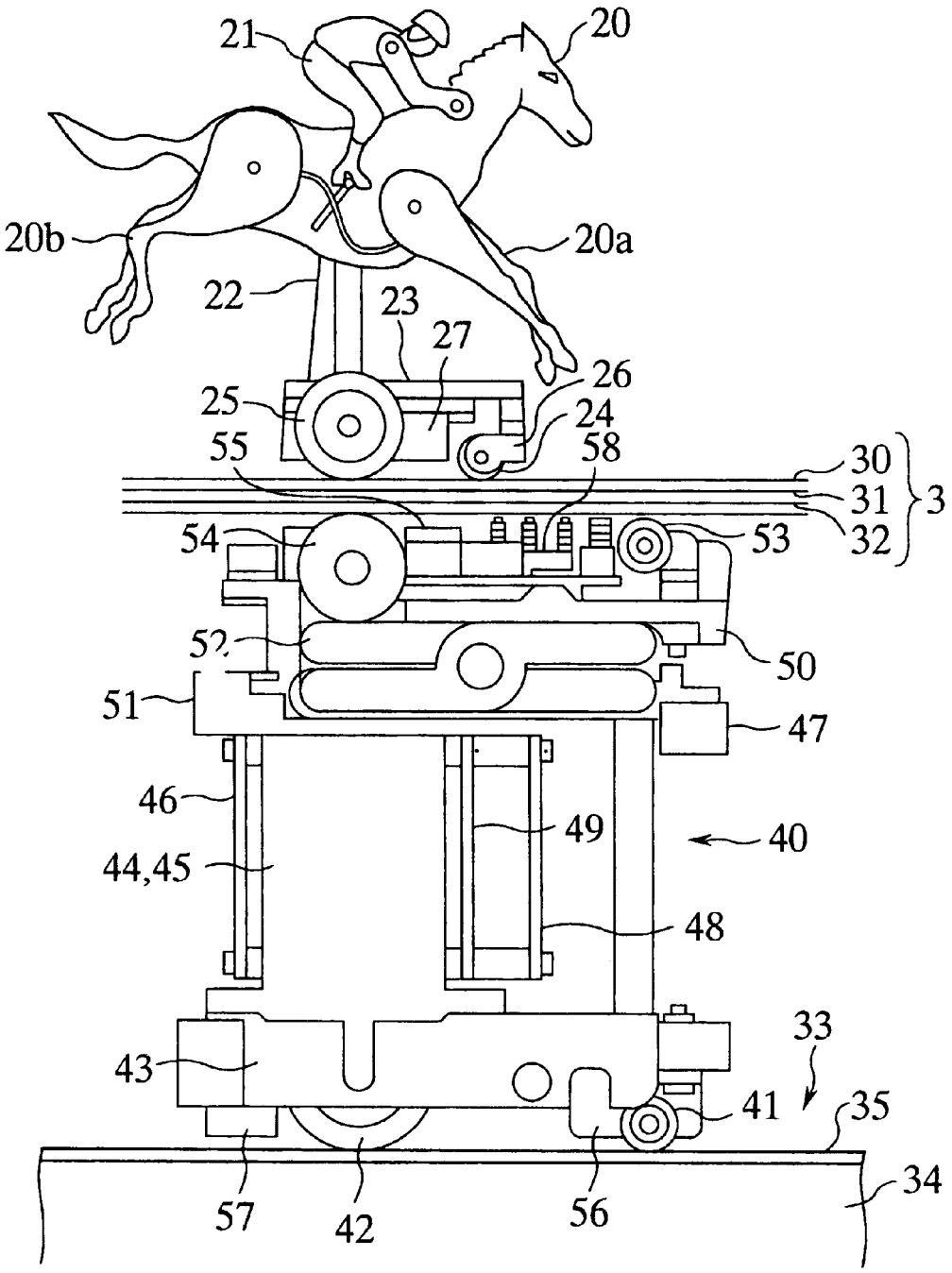
FIG. 2 is a detailed view of a model horse used in the horserace game device according to the first embodiment of the present invention.

Model horses 20 used in the horserace game device will be detailed with reference to FIG. 2.

Each model horse 20 is supported on a truck 23 by means of a support rod 22. The truck 23 has a front wheel 24 and two left and right rear wheels 25. The rotary shaft of the rear wheels 25 is fixed, but the front wheel 24 is supported by a support member 26 which is turnably pivoted to the truck 23 so as to smoothly change a running direction of the model horse.

A magnet 27 is disposed between the left and the right rear wheels 23 with the bottom surface thereof spaced by a small gap from the upper surface of the track 3. By the use of an attraction force of the magnet 27 the model horses 20 are freely moved on the track 3.

0014

Each model horse 20 has forelegs 20*a* and hind legs 20*b* which swing to–and–fro in accordance with rotations of the rear wheel 25, and corresponding to this the model jockey 21 on the model horse 20 also swings, whereby the model horse runs like an actual horse.

The track 3 for model horses to run on has a three-layer structure. On the uppermost layer there is provided a design field 30 of an aluminium plate having the surface electrostatically flocked so that the surface has a real lawn-like appearance. A reinforcement plate 31 is provided on the intermediate layer for reinforcing the track 3. On the lowermost layer there is provided a feeder panel for supplying electric power to carriers 40 which will be described later.

A driving course 33 for the carriers 40 to be driven along is laid below the feeder panel 32 with a space therefrom. The driving course 33 is provided by an acryl plate 35 disposed on the top surface of a position detecting panel 34 which will be described later. The carriers 40 are driven along the driving course 33 to run the model horses 20 on the track 3.

Each carrier 40 has a base 43, and the base is supported by front wheels 41 and rear wheels 42. A front oscillation coil 56 and a rear oscillation coil 57 are disposed respectively near the front wheels 41 and the rear wheels 42.

In the present embodiment, the front oscillation coil 56 and the rear oscillation coil 57 have different oscillation frequencies from each other so that the front oscillation coil 56 and the rear oscillation coil 57 can detect positions of the front wheels 41 and the rear wheels 42 independently of each other. For example, the front oscillation coil 56 has a 455 kHz oscillation frequency, and the rear oscillation coil 57 has a 500 kHz oscillation frequency.

On the base 43 there are provided a right motor 44 and a left motor 45 for respectively driving the right rear wheel 44 and the left rear wheel 44. A driving circuit for driving the right motor 44 and the left motor 45 is mounted on a motor drive substrate 46.

A photodetector 47 for detecting an optical signal to the carrier is mounted on the base 43. On the base 43 there are provided an oscillator substrate 48 with an oscillator which will be described later mounted on, and a CPU substrate 49 with a CPU for general control and its peripheral circuits mounted on.

Two plate member 50, 51 are disposed through a link member 52 on the right motor and the left motor 45, the motor drive substrate 46, the oscillator substrate 48 and the CPU substrate 49. The upper plate member 50 is urged upward by the link member 52.

A front roller 53 and a rear roller 54 are provided on the plate member 50, and a magnet 55 for attracting the magnet 27 of the model horse 20 and a current collector unit 58 for supplying electric power from the feeder panel 33 are provided between the front roller 53 and the rear roller 54.

The carrier 40 receives electric power from the feeder panel 32 through the current collector unit 58 and is driven in accordance with a control signal received by the photodetector 47. The magnet 55 of the carrier 40 is strongly attracted to the magnet 27 of the model horse 20, so that the model horse 20 on the track 33 runs following the carrier 40.

A current position of the carrier 40 is detected by the position detecting panel 34, based on oscillation signals outputted by the front oscillation coil 56 and the rear oscillation coil 57, which are disposed on a forward part and a rear part of the base 43.

Figure 3A:
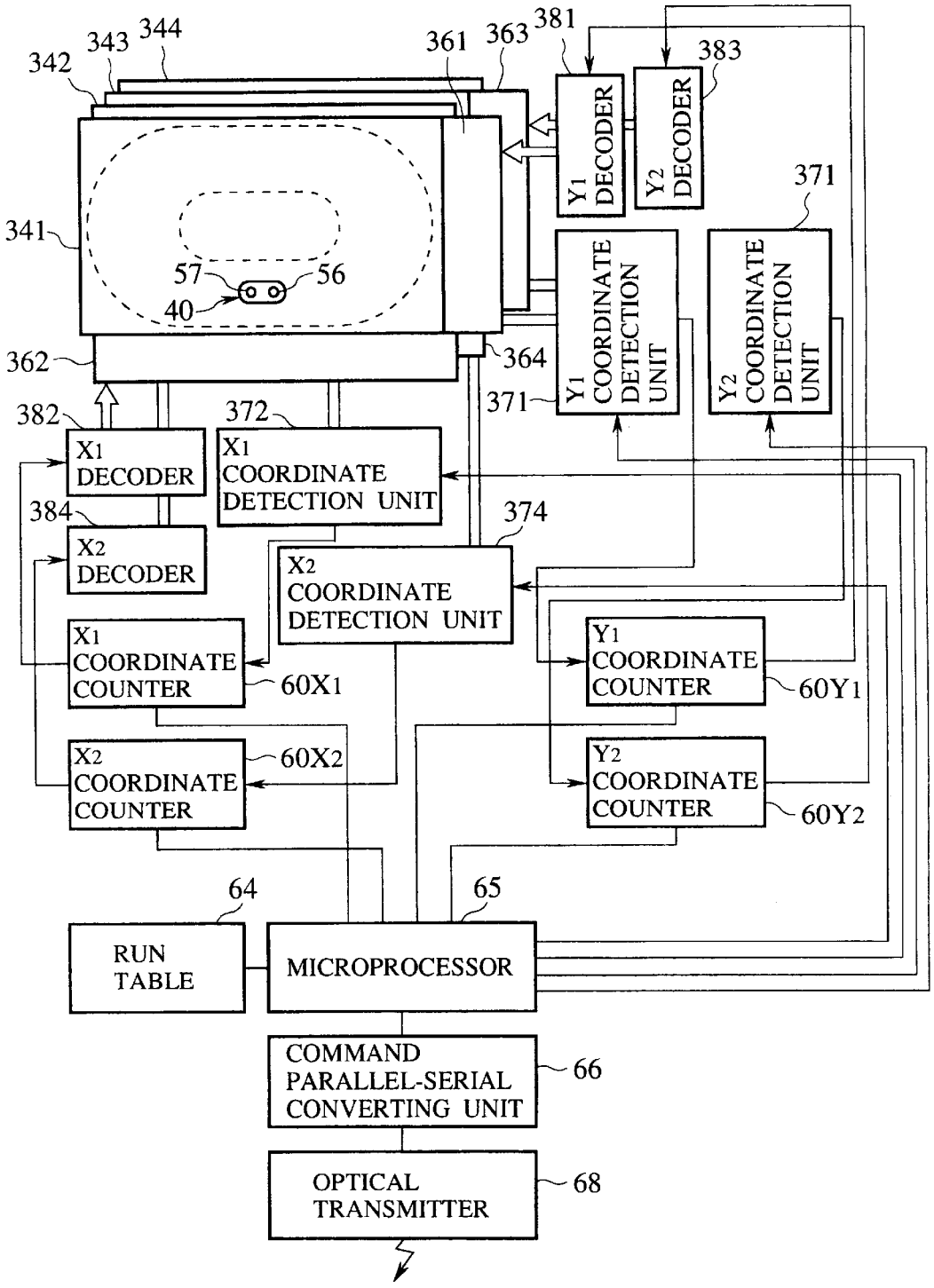
FIGS. 3A and 3B are block diagrams of the horserace game device according to the first embodiment of the present invention.
Figure 3B:
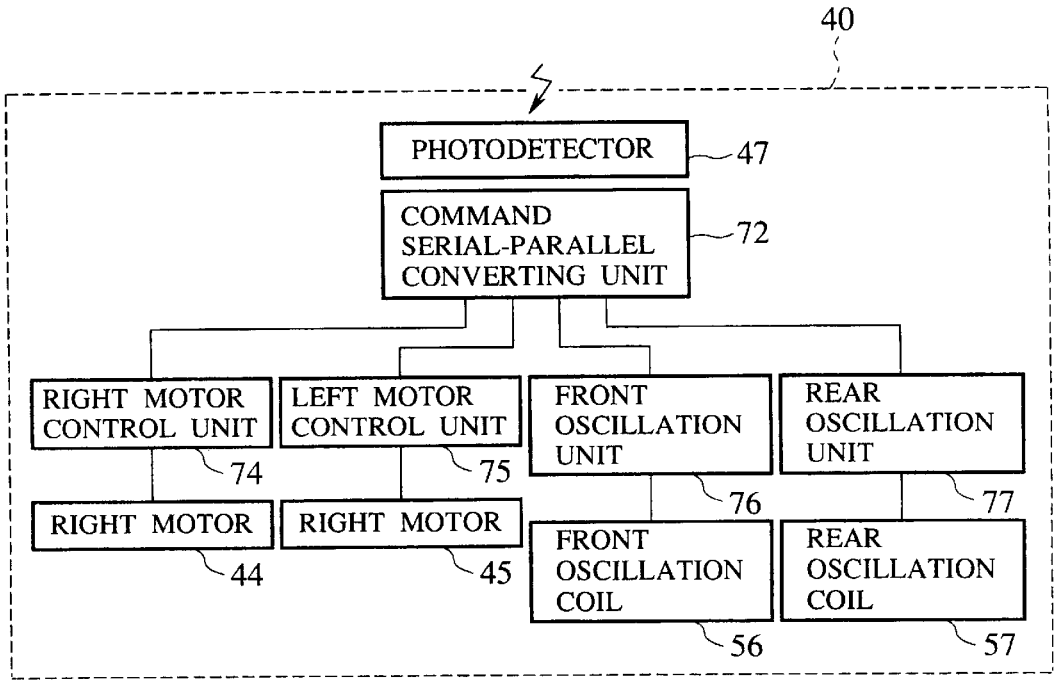
Figure 4:
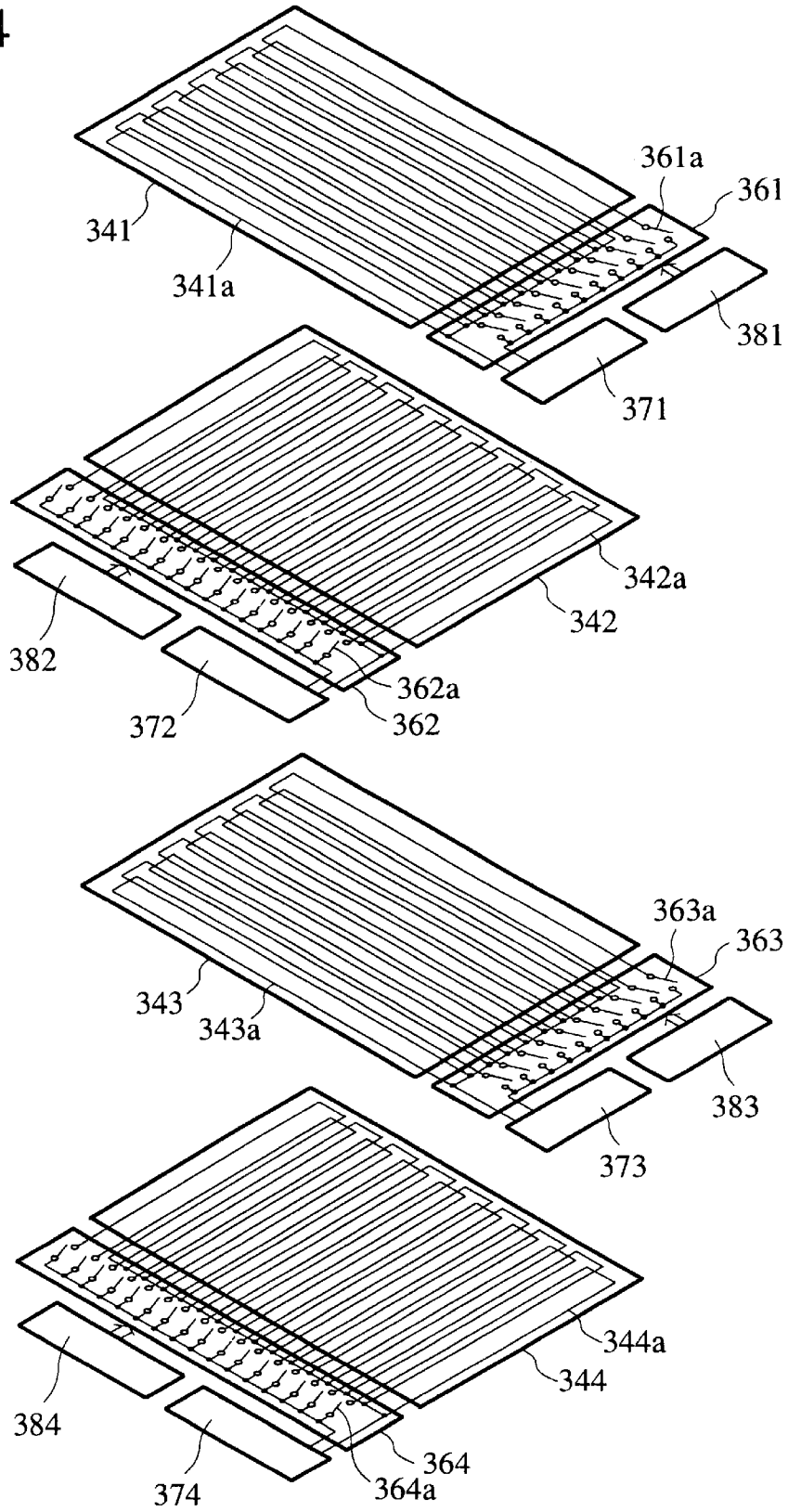
FIG. 4 is a broken perspective view of a structure of a position detection panel used in the horserace game device according to the first embodiment of the present invention.

Then, a general structure of the horserace game device will be explained with reference to FIGS. 3A to 4. FIGS. 3A and 3B are block diagrams of the general structure of the horserace game device. FIG. 4 is a broken perspective view of the position detection panel used in the horserace game device.

First, the position detection panel 34 will be explained with reference to FIG. 4.

The position detection panel 34 comprises four panels of a Y1 detection panel 341, an X1 detection panel 342, a Y2 detection panel 343 and an X2 detection panel 344 which are laid one on another. The Y1 detection panel 341 and the Y2 detection panel 343 are for detecting Y-axial positions, and the X1 detection panel 342 and the X2 detection panel 344 are for detecting X-axial positions. The Y1 detection panel 341 and the X1 detection panel 342 detect a position of the front oscillation coil 56, and the Y2 detection panel and the X2 detection panel 344 detect a position of the rear oscillation coil 57.

The Y1 detection panel 341 and the Y2 detection panel 343 each include a number of elongate coils 341*a*, 343*a* extended length-wise for detecting Y-axial positions.

The respective coils 341*a* have one ends connected to respective switches 361*a* of a Y1 scan unit 361 and the other ends connected commonly. The switches 361*a* have the other ends connected commonly. The commonly connected ends of the coils 341*a* and the commonly connected ends of the switches 361*a* are connected to a Y1 coordinates detection unit 371.

The respective coils 343*a* have one ends connected of one ends of respective switches 363*a* of a Y2 scan unit 363 and the other ends connected commonly. The respective switches 363*a* have the other ends connected commonly. The commonly connected ends of the coils 343*a* and the commonly connected ends of the switches 363*a* are connected to a Y2 coordinate detection unit 373.

The X1 detection panel 342 and the X2 detection panel 344 respectively include a number of elongate coils 342*a*, 344*a* extended widthwise for detecting X-axial positions.

The respective coils 342*a* have one ends connected to one ends of respective switches 362*a* and the other ends connected commonly. The respective switches 362*a* have the other ends connected commonly. The commonly connected ends of the coils 342*a* and the commonly connected ends of the switches 362*a* are connected to an X1 coordinate detection unit 372.

The respective oils 344*a* have one ends connected to one ends of respective switches 364*a* of an X2 scan unit 364 and the other ends connected commonly. The respective switches 364*a* have the other ends connected commonly. The commonly connected ends of the coils 344*a* and the commonly connected ends of the switches 364*a* are connected to an X2 coordinate detection unit 374.

The Y1 scan unit 361 and the Y2 scan unit 363 respectively include a Y1 decoder 381 and a Y2 decoder 383. The Y1 decoder 381 and the Y2 decoder 383 decode count values given by a Y1 coordinate counter 60Y1 and a Y2 coordinate counter 60Y2, which indicate currently scanned Y-axial coordinate values to turn on the switches 361*a*, 363*a* of the Y1 scan unit 361 and the Y2 scan unit 363 corresponding to the count values.

The X1 scan unit 362 and the X2 scan unit 364 respectively include an X1 decoder 382 and an X2 decoder 384. The X1 decoder 382 and the X2 decoder 384 decode count values given by an X1 coordinate counter 60X1 and an X2 coordinate counter 60X2, which indicate currently scanned X-axial coordinate values to turn on the switches 362*a*, 364*a* of the X1 scan unit 362 and the X2 scan unit 364 corresponding to the count values.

Next, the general structure of the horserace game device will be explained with reference to FIGS. 3A and 3B.

As described above, the position detection panel 34 comprises the four panels laid one on another of the Y1 detection panel 341, the X1 detection panel 342, the Y2 detection panel 343 and the X2 detection panel 344. The Y1 detection panel 341 includes the Y1 scan unit 361, the Y1 coordinate detection unit 371, and the Y1 decoder 381. The X1 detection panel 342 includes the X1 scan unit 362, the X1 coordinate detection unit 372, and the X1 decoder 382. The Y2 detection panel 343 includes the Y2 scan unit 363, the Y2 coordinate detection Unit 373, and the Y2 decoder 383. The X2 detection panel 344 includes the X2 scan unit 364, the X2 coordinate detection unit 374 and the X2 decoder 384.

Count values of the X1 coordinate counter 60X1 and the X2 coordinate counter 60X2 indicate X-axial coordinates. Count values of the Y1 coordinate counter 60Y1 and the Y2 coordinate counter 60Y2 indicate Y-axial coordinates. The X1 decoder 382 and the X2 decoder 384 respectively decode the count values of the X1 coordinate counter 60X1 and the X2 coordinate counter 60X2 to turn on those of the switches 362*a*, 364*a* of the X1 scan unit 362 and the X2 scan unit 364 corresponding to the count values.

Similarly, the Y1 decoder 381 and the Y2 decoder 383 respectively decode count values of the Y1 coordinate counter 60Y1 and the Y2 coordinate counter 60Y2 to turn on those of the switches of the Y1 scan unit 361 and the Y2 scan unit 363 corresponding to the count values.

As described above, the front oscillation coil 56 and the rear oscillation coil 57 have oscillation frequencies different from each other, and that of the front oscillation coil 56 is 455 kHz, and that of the rear oscillation coil 57 is 500 kHz.

The X1 coordinate detection unit 372 and the Y1 coordinate detection unit 371 includes band-path filters (not shown) for 455 kHz signals, and wave detectors (not shown) to selectively detect oscillation signals of 455 kHz oscillated by the front oscillation coil 56. When the front oscillation coil 56 is near the coils 342*a*, 341*a* connected to the switches 362*a*, 361*a*, current of a 455 kHz frequency oscillated by the front oscillation coil 56 is induced to the coils 342*a*, 341*a*. When the X1 coordinate detection unit 372 and the Y1 coordinate detection unit 371 detect this induced current, they stop the X1 coordinate counter 60X1 and the Y1 coordinate counter 60Y1 counting. Count values given by the X1 coordinate counter 60X1 and the Y1 coordinate counter 60Y1 when they stopped are an X1 coordinate and a Y1 coordinate.

The X2 coordinate detection unit 374 and the Y2 coordinate detection unit 373 include band-path filters (not shown) for 500 kHz signals, and wave detectors (not shown) to selectively detect oscillation signals of 500 kHz oscillated by the rear oscillation coil 57. When the rear oscillation coil 57 is near the coils 344*a*, 343*a* connected to the switches 364*a*, 363*a*, current of a 500 kHz frequency oscillated by the rear oscillation coil 57 is induced to the coils 344*a*, 343*a*. When the X2 coordinate detection unit 374 and the Y2 coordinate detection unit 373 detect this induced current, they stop the X2 coordinate counter 60X2 and the Y2 coordinate counter 60Y2 counting. Count values given by the X2 coordinate counter 60X2 and the Y2 coordinate counter 60Y2 when they stopped are an X2 coordinate and a Y2 coordinate.

A run table 64 stores positional coordinates of model horses 20, i.e., carriers 40, for each control period, running at a predetermined speed along predetermined running courses. The positional coordinates are coordinates of target positions of the carriers.

A microprocessor 65 generally controls the racehorse game device.

The microprocessor 65 obtains positional information of the front oscillation coil 56, based on count values of the X1 coordinate counter 60X1 and the Y1 coordinate counter 60Y1 at the time when they are stopped, and positional information of the rear oscillation coil 57, based on count values of the X2 coordinate counter 60X2 and the Y2 coordinate counter 60Y2 at the time when they are stopped.

The microprocessor 65 controls movement of a carrier 40, based on positional information of the front oscillation coil 56 and the rear oscillation coil 57 so that the carrier 40 is driven along a running course stored in the run table 64. Specifically, the microprocessor 65 compares obtained positional coordinates of the front oscillation coil 56 and the rear oscillation coil 57 with coordinates of a target position stored in the run table 64 to control drive of the right motor 44 and the left motor 45 so that the carrier 40 agrees with the target positional coordinates.

The microprocessor 65 outputs drive control command for the right motor 44 and the left motor 45 and oscillation control commands for the front oscillation coil 56 and the rear oscillation coil 57.

A command parallel-serial conversion unit 66 converts a command from the microprocessor 65 to a serial signal and output the serial signal to an optical transmitter 68. The optical transmitter 68 transmits an optical signal to the carrier 40 in response to the inputted serial signal.

The photodetector 47 of the carrier 40 detects the optical signal from the optical transmitter 68 and outputs the optical signal to a command serial-parallel conversion unit 72 as a serial signal. The command serial-parallel conversion unit 72 converts the inputted serial signal to a parallel signal and outputs the parallel signal as a control command to the right motor control unit 74, the left motor control unit 75, the from oscillation control unit 76 and the rear oscillation control unit 77.

The right motor control unit 74 controls drive of the right motor 44 in accordance with an inputted drive control command. The left motor control unit 75 controls drive of the left motor 45 in accordance with an inputted drive control command. The front oscillation control unit 76 controls oscillation of the front oscillation coil 56 in accordance with the inputted drive control command. The rear oscillation control unit 77 controls oscillation of the rear oscillation control unit 77 in accordance with the inputted oscillation control signal.

Figure 5:
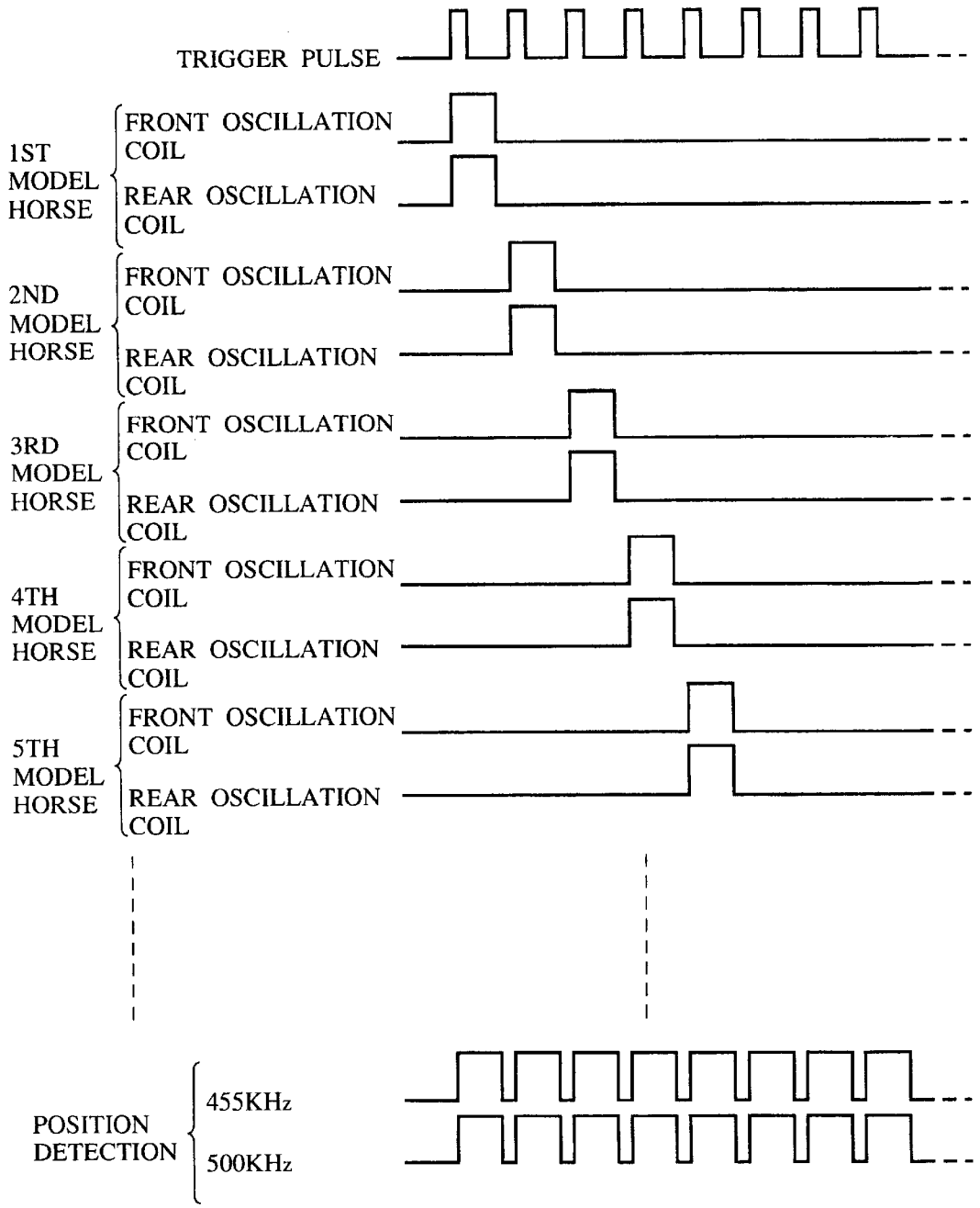
FIG. 5 is a time chart of the operation of the horserace game device according to the first embodiment of the present invention.

Then, the operation of the horserace game device will be explained with reference to FIG. 5. FIG. 5 is a time chart of the operation of the racehorse game device.

In the conventional horserace game device, a position of only one oscillation coil can be detected by one position detection, and to detect a position of one carrier 40, a position detecting time of twice position detections for the front oscillation coil 56 and the rear oscillation coil 57 is required. However, in the horserace game device according to the present embodiment, positions of the two oscillation coils can be concurrently detected by once position detection. In a once-position detection time positions of the front oscillation coil 56 and the rear oscillation coil 57 of one carrier 40 can be concurrently estimated.

As shown in FIG. 5, the position detection by the present embodiment is synchronous with trigger pulses.

By a first trigger pulse, the front oscillation coil 56 and the rear oscillation coil 57 of a carrier 40 driving one model horse 20 are concurrently oscillated. The front oscillation coil 56 is oscillated at 455 kHz, and the rear oscillation coil 57 is oscillated at 500 kHz. Count values of the X1 coordinate counter 60X1, the X2 coordinate counter 60X2, the Y1 coordinate counter 60Y1 and the X2 coordinate counter 60Y2 are continuously changed so that a required range of the position detection panel 34 is scanned.

It is preferable that a scan range of the position detection panel 34 is limited to a required minimum range which is based on coordinates of a previously detected position of the first model horse 20, and a running course in the run table 64. That is, based on the position coordinates of the first model horse given by the previous position detection, a region of an anticipated one of running courses of the first model horse stored in the run table 64 is determined.

Corresponding to count values given by the X1 coordinate counter 60X1 and the X2 coordinate counter 60X2, those of the switches 362*a*, 364*a* of the X1 scan unit 362 and the X2 scan unit 364*a* are turned on, while corresponding to count values given by the Y1 coordinate counter 60Y1 and the Y2 coordinate counter 60Y2, those of switches 361*a*, 363*a* of the Y1 scan unit 361 and the Y2 scan unit 363 are turned on.

The X1 coordinate detection unit 372 and the Y1 coordinate detection unit 371 detect induced current of a 455 kHz frequency. When induced current is detected, counting of the X1 coordinate counter 60X1 and the Y1 coordinate counter 60Y1 is stopped. Simultaneously therewith, the X2 coordinate detection unit 374 and the Y2 coordinate detection unit 373 detect induced current of a 500 kHz. When induced current is detected, counting of the X2 coordinate counter 60X2 nd the Y2 coordinate counter 60Y2 is stopped. Thus, positions of the front oscillation coil 56 and the rear oscillation coil 57 driving the first model horse are detected.

By a next trigger pulse, the front oscillation coil 56 and the rear oscillation coil 57 of a carrier 40 for driving a second model horse 20 are oscillated. In the same way as the first model horse, a position of the second model horse 20 is detected.

In the same way, position of a third model horse, a fourth model horse, a fifth model horse, . . . are sequentially detected.

When a scan range for one position detection is 10 cm×10 cm, the one position detection takes about 70 psec. When 60-time position detections for 1 second are possible for one model horse, a required time for position detection for one model horse is $$700\ psec \times 60\ times = 42\ msec$$

Therefore, although 12 model horses can be run in one race in the present embodiment, 23 model horses at maximum can be run in one race.

As described above, according to the present embodiment, a number of model horses which is more than twice a number of model horses run in the conventional horserace game device can be run. The horserace game device according to the present embodiment can amuse game players.

A Second Embodiment

Figure 6A:
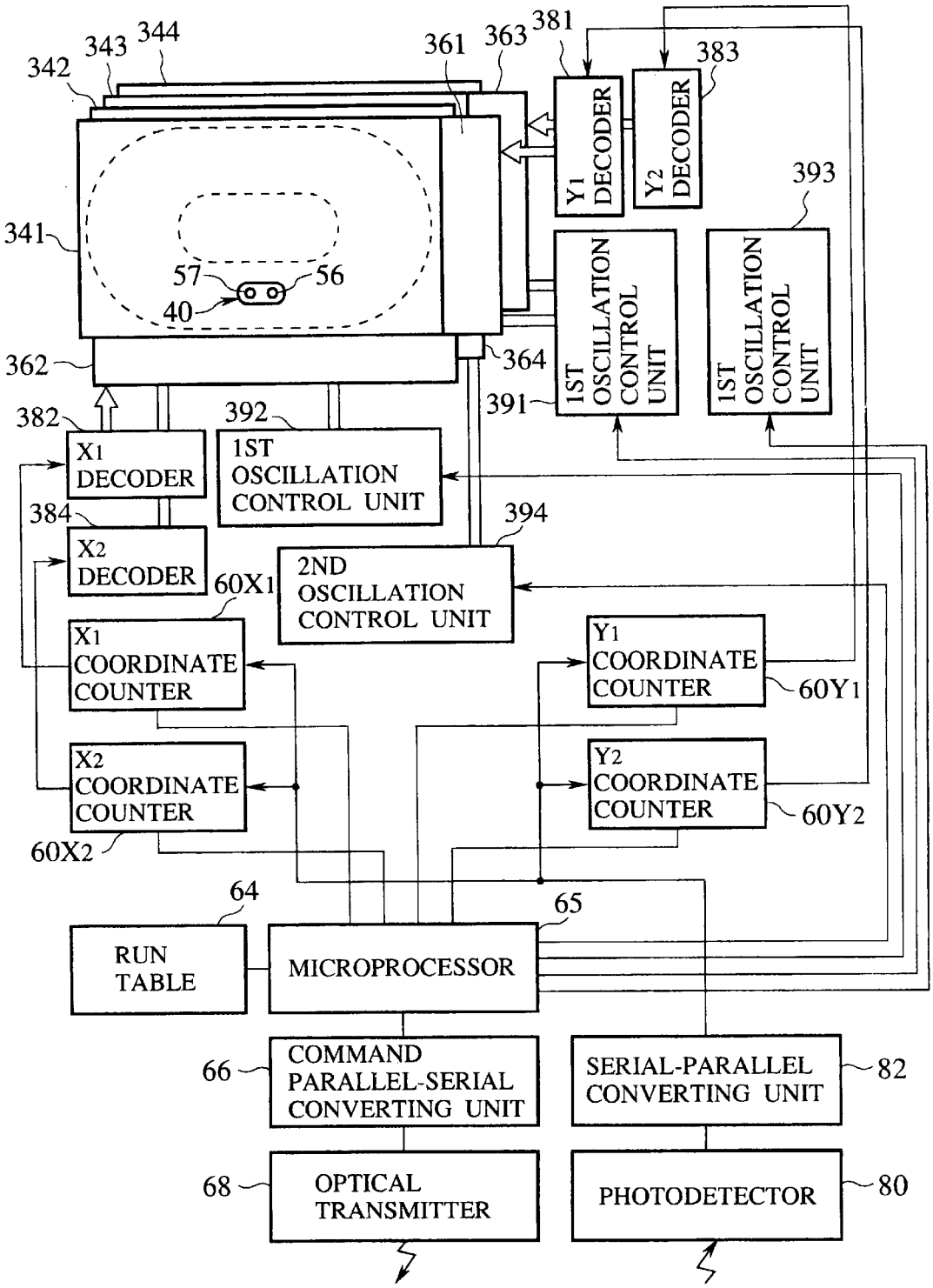
FIGS. 6A and 6B are block diagrams of the horserace game device according to a second embodiment of the present invention.
Figure 6B:
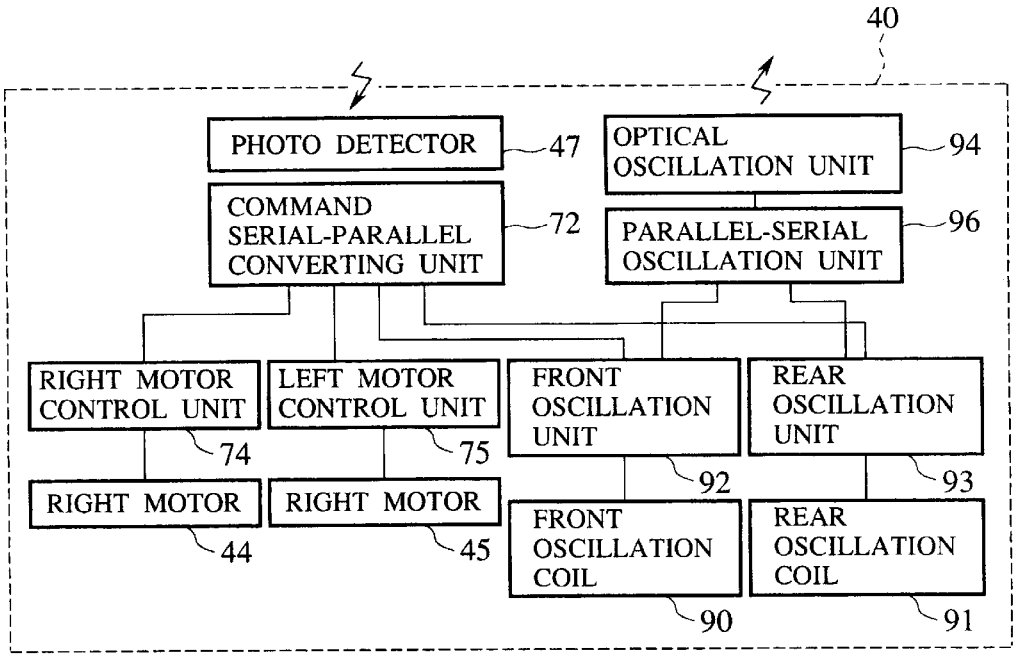
Figure 7:
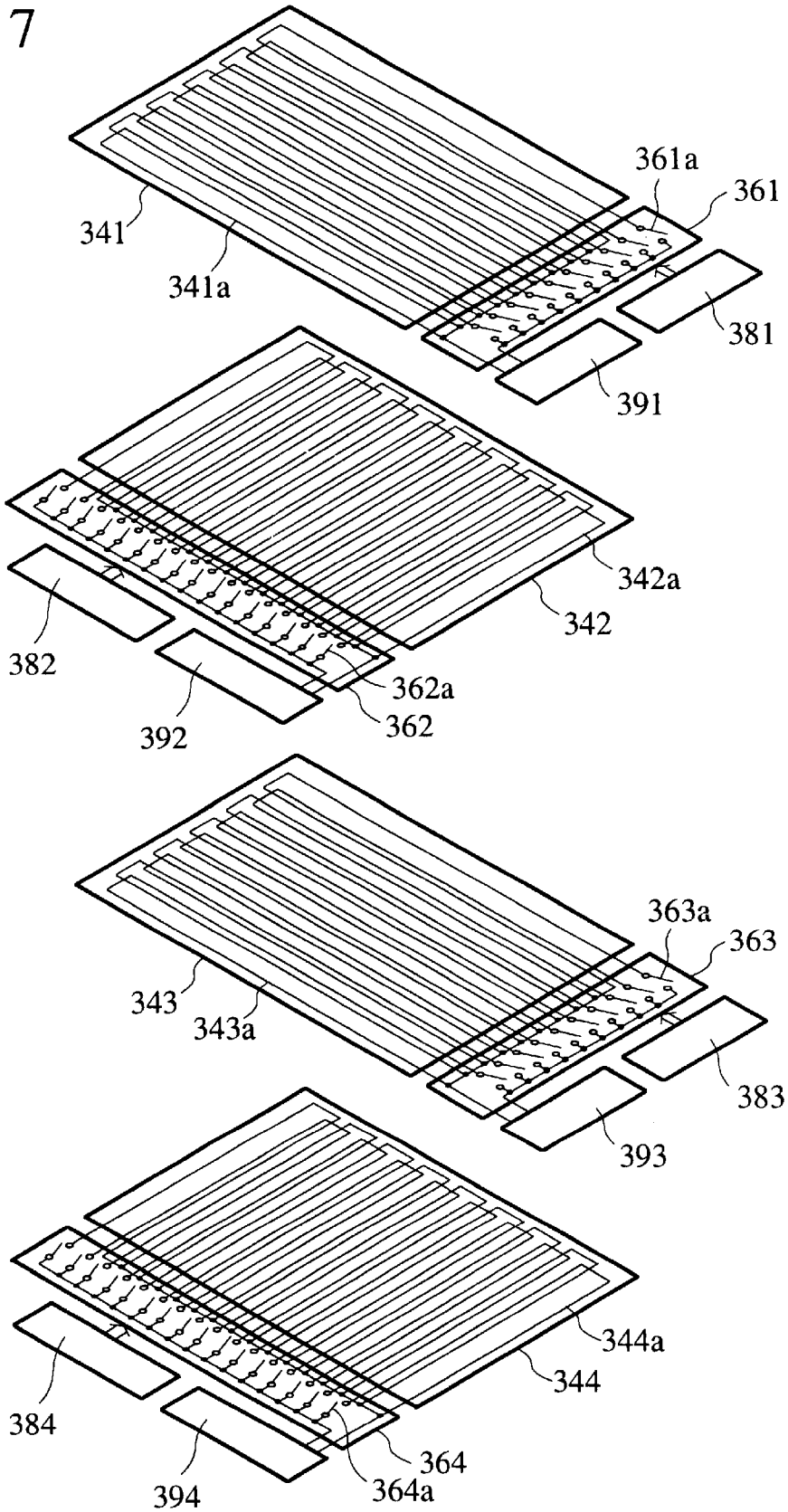
FIG. 7 is a broken perspective view of a structure of a position detection pane used in the horserace game device according to the second embodiment of the present invention.
Figure 8:
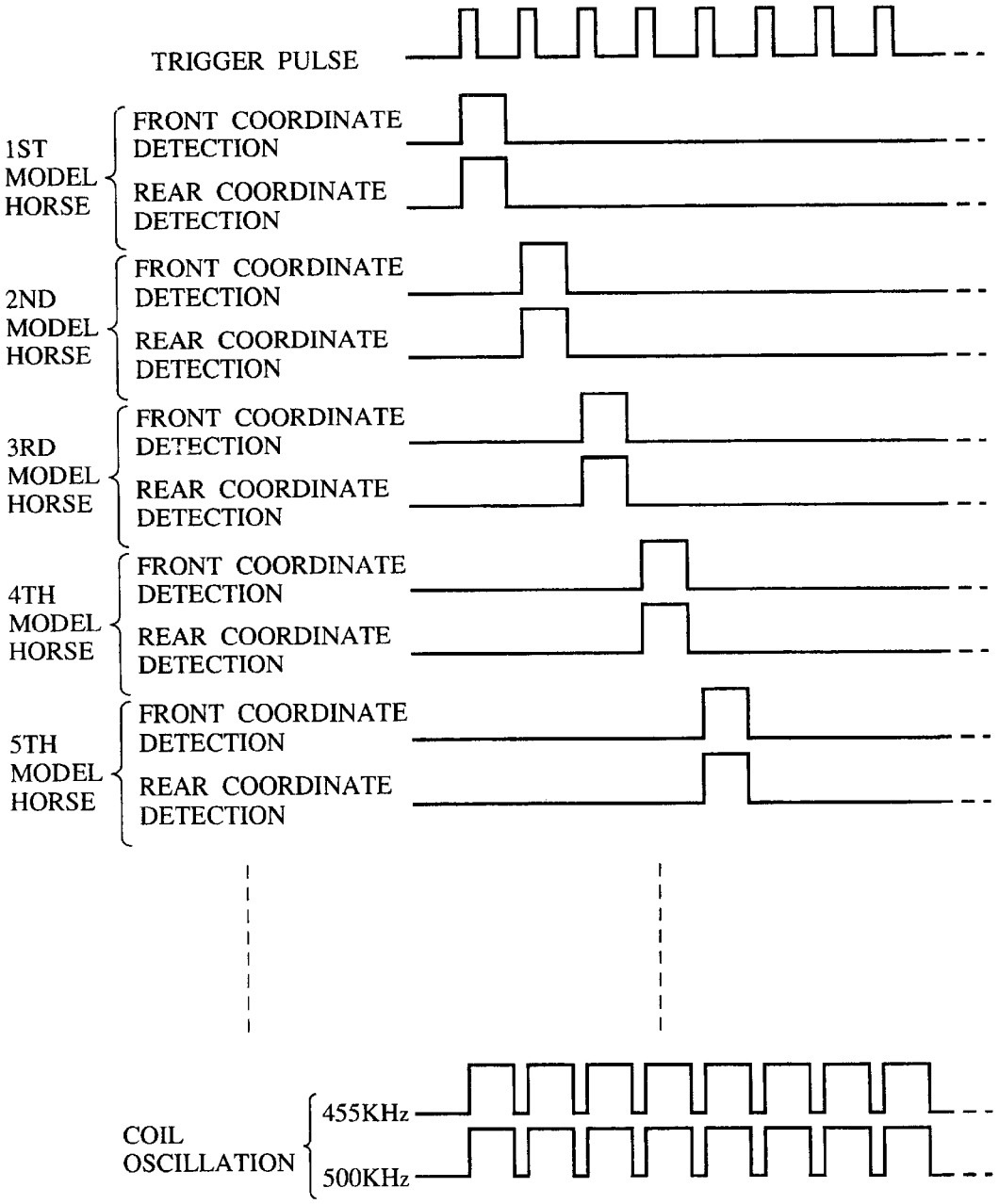
FIG. 8 is a time chart of the operation of the horserace game device according to the second embodiment of the present invention.

The horserace game device according to a second embodiment of the present invention will be explained with reference to FIGS. 6A to 8. FIGS. 6A and 6B are block diagrams of a general structure of the horserace game device. FIG. 7 is broken perspective view of a structure of a position detection panel used in the horserace game device. FIG. 8 is a time chart of the operation of the horserace game device. The same members of the present embodiment are represented by the same reference numerals not to repeat their explanation.

In the first embodiment, the oscillation coils are mounted on each carrier, and an oscillation signal from an oscillation coil is detected by the position detection panel, but in the second embodiment, coils of a position detection panel are sequentially oscillated, and oscillation signals are detected by a coil of a carrier.

First, the position detection panel 34 will be explained with reference to FIG. 7.

As in the first embodiment, the position detection panel 34 comprises four panels of a Y1 detection panel 341, an X1 detection panel 342, a Y2 detection panel 343 and an X2 detection panel 344 which are laid one on another. The Y1 detection panel 341 and the Y2 detection panel 343 are for detecting Y-axial positions, and the X1 detection panel 342 and the X2 detection panel 344 are for detecting X-axial positions. Coils 341*a*, 342*a* of the Y1 detection panel 341 and the X2 detection panel 342 are sequentially oscillated at a 455 kHz frequency, and coils of the Y2 detection panel and the X2 detection panel 344 are sequentially oscillated at a 500 kHz.

Commonly connected ends of the coils 341*a* of the Y1 detection panel 341 and commonly connected ends of the switches 361*a* are connected to a first oscillation control unit 391 of 455 kHz. Commonly connected ends of the coils 342*a* of the X1 detection panel 342, and commonly connected ends of switches 363*a* are connected to a first oscillation control unit 392 of 455 kHz.

Commonly connected ends of the coils 343*a* of the Y1 detection panel 343 and commonly connected ends of the switches 363*a* are connected to a second oscillation control unit 393 of 500 kHz. Commonly connected ends of the coils 343*a* of the X1 detection panel 343, and commonly connected ends of switches 363*a* are connected to a second oscillation control unit 394 of 500 kHz.

Then, the general structure of the horserace game device will be explained with reference to FIGS. 6A and 6B.

As described above, the position detection panel 34 comprises four detection panels of the Y1 detection panel 341, the X1 detection panel 342, the Y2 detection panel 343 and the X2 detection panel 344 laid one on another. The Y1 detection panel 341 includes a Y1 scan unit 361, a first oscillation control unit 391 and a Y1 decoder 381. The X1 detection panel 342 includes an X1 scan unit 362, a first oscillation control unit 392 and an X1 decoder 382. The Y2 detection panel 343 includes a Y2 scan unit 363, a second oscillation control unit 393 and a Y2 decoder 383. The X2 detection panel 344 includes an X2 scan unit 364, a second oscillation control unit 394 and an X2 decoder 384.

As described above, the first oscillation control units 391, 392, and the second oscillation control units 393, 394 have different oscillation frequencies different from each other. The first oscillation control units 391, 392 have a 455 kHz frequency, and the second oscillation control units 393, 394 have a 500 kHz frequency.

A microprocessor 65 generally control the horserace game device. The microprocessor 65 outputs drive control commands for a right motor 44 and a left motor 45, and detection control commands for a front coordinate detection unit 92 and a rear coordinate detection unit 93 of a carrier 40.

A photodetector 47 of the carrier 40 receives an optical signal from an optical transmitter 68 and converts the optical signal to a serial signal to output the serial signal to a command serial-parallel conversion unit 72. The command serial-parallel conversion unit 72 converts inputted serial signal to parallel signal to output the same as a control command to a right motor control unit 74, a left motor control 75, a front coordinate detection unit 92 and a rear coordinate control unit 93.

The front coordinate detection unit 92 includes a bandpass filter (not shown) for the 455 kHz signal, and a wave detector (not shown) and selectively detects 455 kHz oscillation signals oscillated by the X1 detection panel 342 and the Y1 detection panel 341. When the coils 342*a,* 341 of the X1 detection panel 342 and the Y1 detection panel 341 near the front detection coil 90 are oscillated, current of a 455 kHz oscillation frequency is induced to the front detection coil 90. When the front coordinate detection unit 92 detects this induced current, an optical signal is outputted from the optical transmitter 94 through the parallel-serial conversion unit 96.

The optical signal is received by a photodetector 80 and is inputted to an X1 coordinate counter 60X1 and a Y1 coordinate counter 60Y1. In response to this optical signal X1 coordinate counter 60X1 and the Y1 coordinate counter 60Y stops counting. Count values given by the X1 coordinate counter 60X1 and the Y1 coordinate counter 60Y1 when they stops counting are an X1 coordinate and a Y1 coordinate. These coordinate values (X1, Y1) are a position of the front detection coil 90.

The rear coordinate detection unit 93 includes a bandpass filter (not shown) for the 500 kHz signal, and a wave detector (not shown) and selectively detects 500 kHz oscillation signals oscillated by the X2 detection panel 344 and the Y2 detection panel 343. When the coils 344*a,* 343*a* of the X2 detection panel 344 and the Y2 detection panel 343 near the rear detection coil 91 are oscillated, current of a 500 kHz oscillation frequency is induced to the rear detection coil 91. When the rear coordinate detection unit 93 detects this induced current, an optical signal is outputted from the optical transmitter 94 through the parallel-serial conversion unit 96.

This optical signal is received by the photodetector 80 and inputs to the X2 coordinate counter 60X2 and the Y2 coordinate counter 60Y2 through the serial-parallel conversion unit 82. In response to this optical signal the X2 coordinate counter 60X2 and the Y2 coordinate counter 60Y2 stop counting. Count values given by the X2 coordinate counter 60X2 and the Y2 coordinate counter 60Y2 are an X2 coordinate and a Y2 coordinate. These coordinate values (X2, Y2) are a position of the rear detection coil 91.

Then, with reference to FIG. 8 the operation of the horserace game device will be explained. FIG. 8 is a time chart of the operation of the horserace game device.

The position detection of the present embodiment is synchronous with trigger pulses.

By a first trigger pulse the coils 341*a,* 342*a* of the Y1 detection panel 341 and the X1 detection panel 342 are sequentially oscillated at a 455 kHz frequency, while the coils 343*a*, 344*a* of the Y2 detection panel 343 and the X2 detection panel 344 are sequentially oscillated at a 500 kHz frequency. The front detection coil 90 and the rear detection coil 91 of a carrier 40 driving a first model horse 20 respectively detects the 455 kHz oscillation signal and the 500 kHz oscillation signal. Count values of the X1 coordinate counter 60X1, the X2 coordinate counter 60X2, the Y1 coordinate counter 60Y1 and the X2 coordinate counter 60Y2 are continuously changed so that a required range of the position detection panel 34 is scanned.

0055

Corresponding to count values given by the X1 coordinate counter 60X1 and the X2 coordinate counter 60X2, those of the switches 362*a,* 364*a* of the X1 scan unit 362 and the X2 scan unit 364*a* are turned on, while corresponding to count values given by the Y1 coordinate counter 60Y1 and the Y2 coordinate counter 60Y2, those of switches 361*a,* 363*a* of the Y1 scan unit 361 and the Y2 scan unit 363 are turned on.

The front coordinate detection unit 92 detects the induced current of a 455 kHz frequency. When the induced current is detected, the X1 coordinate counter 60X1 and the Y1 coordinate counter 60Y1 stop counting. Simultaneously therewith, the rear coordinate detection unit 93 detect the induced current of a 500 kHz frequency. When the induced frequency is detected, the X2 coordinate counter 60X2 and the Y2 coordinate counter 60Y2 stop counting. Thus, a position of the front detection coil 90 and the rear detection coil 91 of a carrier 40 driving the first model horse 20.

By a next trigger pulse a position of a second model horse 20 is detected, as is the first model horse, by the front detection coil 90 and the rear detection coil 91 of a carrier 40 driving the second model horse 20.

In the same way positions of a third model horse, a fourth horse, a fifth model horse, . . . are sequentially detected.

As described above, according to the present embodiment, positions of the front detection coil 90 and the rear detection coil 91 of one carrier 40 can be concurrently given in a position detecting time for one detection. Accordingly a number of model horses which is more than twice a number of mode horses in the conventional horserace game device can be run. The horserace game device according to the present embodiment amuses game players.

The present invention is not limited to the above-described embodiment and covers other various modifications.

For example, in the above-described embodiments, to detect a position of a model horse, positions of two points are detected, but it is possible to detect positions of three or more points. The position detection may use a method other than the electromagnetic method, such as electrostatic induction method or ultrasonic method. Furthermore, in the above-described embodiment, the present invention is applied to the horserace game device but is applicable to other game devices. Furthermore, it is needless to say that the present invention is applicable to position detection of movable objects in factories, such as robots, etc.

What is claimed is:

1. A movable object position detecting apparatus for detecting a position of a movable object running on a predetermined field, the apparatus comprising:

first oscillation means mounted on the movable object for outputting an oscillation signal of a first frequency;

second oscillation means mounted on the movable object for outputting an oscillation signal of a second frequency different from the first frequency;

first position detecting means disposed on the field for the movable object to be run on for detecting the oscillation signal of the first frequency outputted by the first oscillation means to detect a position on the field where the first oscillation means mounted on the movable object is located; and second position detecting means disposed on the field for the movable object to be run on for detecting the oscillation signal of the second frequency outputted by the second oscillation means to detect a position on the field where the second oscillation means mounted on the movable object is located.

2. A movable object position detecting apparatus according to claim 1, wherein the first position detecting means and the second position detecting means substantially simultaneously detect the positions of the first oscillation means and the second oscillation means.

3. A movable object position detecting apparatus according to claim 1, wherein the first position detecting means comprises a first coordinate detecting means for detecting a first coordinate of the position of the first oscillation means, and a second coordinate detecting means for detecting a second coordinate of the position of the first oscillation means; and the second position detecting means comprises a first coordinate detecting means for detecting a first coordinate of the position of the second oscillation means, and a second coordinate detecting means for detecting a second coordinate of the position of the second oscillation means.

4. A movable object position detecting apparatus according to claim 1, wherein the first oscillation means is mounted on a front part of the movable object, and the second oscillation means is mounted on a rear part of the movable body.

5. A movable object position detecting apparatus for detecting a position of a movable object running on a predetermined field, the apparatus comprising:

first oscillation means disposed on the field for the movable object to be run on for outputting oscillation signals of a first frequency, changing oscillation positions of the oscillation signals;

second oscillation means disposed on the field for the movable object to be run for outputting oscillation signals of a second frequency different from the first frequency, changing oscillation positions of the oscillation signals;

first detecting means mounted on the movable object for detecting the oscillation signals of the first frequency outputted by the first oscillation means;

second detecting means mounted on the movable object for detecting the oscillation signals of the second frequency outputted by the second oscillation means;

first position detecting means for detecting a position on the field where the first detecting means mounted on the movable body is located, based on a detection result of the first detecting means; and second detecting means for detecting a position on the field where the second detecting means mounted on the movable object is located, based on a detection result of the second detecting means.

6. A movable object position detecting apparatus according to claim 5, wherein the first position detecting means and the second position detecting means substantially simultaneously detect the positions of the first oscillation means and the second oscillation means.

7. A movable object position detecting apparatus according to claim 5, wherein the first detecting means is mounted on a front part of the movable body, and the second detecting means is mounted on a rear part of the movable object.

8. A race game device which uses a position detecting apparatus according to claim 1, and in which movable objects are run for race.

9. A race game device which uses a position detecting apparatus according to claim 5, and in which movable objects are run for race.

* * * * *